US005575057A

United States Patent [19]

Seitz

[11] Patent Number: 5,575,057

[45] Date of Patent: Nov. 19, 1996

[54] METHOD OF MANUFACTURING A COIN DETECTOR

[75] Inventor: Thomas Seitz, Zug, Switzerland

[73] Assignee: Landis & Gyr Technology Innovation AG, Zug, Switzerland

[21] Appl. No.: 410,066

[22] Filed: Mar. 24, 1995

Related U.S. Application Data

[63] Continuation of Ser. No. 72,913, May 17, 1993, Pat. No. 5,411,126.

[30] Foreign Application Priority Data

Jun. 3, 1992 [CH] Switzerland ..... 1782/92

[51] Int. Cl.[6] ..... H01F 41/02

[52] U.S. Cl. ..... 29/602.1; 194/319

[58] Field of Search ..... 29/602.1, 840, 29/846, 827; 194/317–319

[56] References Cited

U.S. PATENT DOCUMENTS 3,185,947 5/1965 Freymodsson ..... 29/602.1 X
4,035,695 7/1977 Knutson et al. ..... 29/602.1 X
4,441,602 4/1984 Ostroski et al. .
5,067,229 11/1991 Nakamura ..... 29/827 X
5,133,118 7/1992 Lindblad et al. ..... 29/840

*Primary Examiner*—Carl E. Hall
*Attorney, Agent, or Firm*—Meltzer, Lippe Goldstein, et al.

[57] ABSTRACT

Coin detector may be manufactured in several steps. An integrated circuit board (ICB) having conductive material on its surface is covered with an etching mask where conductive elements are to be located. The unmasked portion of the ICB surface is etched off, and then the etching mask is removed. The ICB substrate is attached with a detector circuit located on an etched portion of the ICB surface. An oscillator circuit is connected to a conductive coil. If the coin detector uses a two-layer coil, the coils are connected by a through-going board. The structure is encased in a synthetic material.

4 Claims, 1 Drawing Sheet

METHOD OF MANUFACTURING A COIN DETECTOR

This is a continuation of U.S. patent application Ser. No. 08/072,913 filed on May 17, 1993 now U.S. Pat. No. 5,411,126.

FIELD OF THE INVENTION

The present invention relates to a process for manufacturing an inductive coin detector. Such coin detectors can be used to identify coins in coin testers, for example.

BACKGROUND OF THE INVENTION

Prior art inductive coin detectors are known, for example, from Great Britain 2,151,062. An inductive coin detector comprises a flat coil in the circuit of a high-frequency oscillator. An alternating magnetic field emerging from the coil penetrates a coin channel perpendicularly. A coin rolling through the alternating field in the coin channel changes the resonance frequency of the oscillator as a result of the alternating effect of the coin with the alternating field. The frequency deviation caused by the presence of the coin is used as a measure of the parameter to be measured, such as diameter, alloy, presence in general, etc. The coil is wound from wire or is produced on a printed circuit by etching a copper lamination. The remaining part of the high-frequency oscillator placed at a distance is connected to the coil via feeders screened against signal interference.

Flat coils which can be produced according to various technical methods are known from U.S. Pat. No. 4,494,100 whereby electric conductive material in the form of a single-layer coil is applied on a flat body made of an insulation material. The coil is bonded at the edge of the insulation material and at the center of the coil.

A method is furthermore known in the manufacture of integrated circuits (IC) by which micro-chips are mounted together with the integrated circuit on supports which are punched out together with connection legs from a strip of sheet metal. After being punched out the sheet metal strip has so-called "lead frames" in a regular sequence, each with a support and with the predetermined number of connection legs. The "lead frames" remain connected on both sides via continuous border strips to the positioning holes. This "lead frame" sheet metal strip allows for a low-cost process in outfitting the support with micro chips, in bonding the connections between the integrated circuit and the corresponding connection legs at regular intervals, and in pressing the circuit into an integrated circuit by means of a synthetic material. The completed IC is then punched out of the lead frame.

It is the object of the invention to provide a method of manufacturing an inductive coin detector with low parasitic radiation which can easily be built into a coin tester or the like.

SUMMARY OF THE INVENTION

The invention comprises a method for manufacturing a coin detector for inductively scanning coins moving in a channel. The detector uses a high frequency alternating magnetic field produced by an LC oscillator and a coil at the coin channel through which the alternating current flows to produce the alternating field penetrating the coin channel at a right cycle to the coin's direction of movement. The coil comprises at least one flat helicoidal conductor arrangement on a flexible insulation film. The detector circuit on a substrate is installed on the insulation foil outside the conductor arrangement. The detector circuit comprises an oscillator circuit and a measuring circuit which monitors the frequency of the LC oscillator to recognize the presence of the coin. The coil and the oscillator circuit comprise the oscillator. The detector circuit is connected via a two pole feeder and a feeding device of the coin tester for energy supply and via a signalling line for signal transmission, to a recognition circuit of the coin tester.

The coin detector may be manufactured in several steps. An integrated circuit board (ICB) having conductive material on its surface is covered with an etching mask where conductive elements are to be located. The unmasked portion of the ICB surface is etched off, and then the etching mask is removed. The ICB substrate is attached with a detector circuit located on an etched portion of the ICB surface. An oscillator circuit is connected to a conductive coil. If the coin detector uses a two-layer coil, the coils are connected by a through-going bond. The structure may be encased in a synthetic material.

BRIEF DESCRIPTION OF THE DRAWINGS

An example of an embodiment of the invention shall be explained in further detail below through the drawings.

DETAILED DESCRIPTION OF A PREFERRED EMBODIMENT

Figure 1:
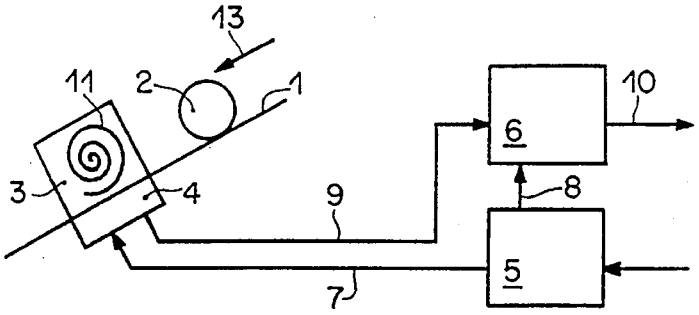
FIG. 1 shows a coin tester having a coin detector according to one embodiment of the present invention.

In FIG. 1, a coin channel 1 is located in a coin tester having a coin 2, a coil 3, a detector circuit 4, a feeding devices and an evaluating unit 6. The feeding device 5 serves to provide power and is connected via feeders 7 to the detector circuit 4 and via feeders 8 to the evaluating unit 6. A signalling line 9 extends from the detector circuit 4 to the evaluating unit 6 to transmit measurement signals. The evaluating unit 6 analyzes the measurement signals in a predetermined manner and is able to trigger a performance via command circuit 10. The coin tester may be built into a public telephone or into an automatic vending machine, for example, and makes it possible to trigger the performance by means of coins 2.

The coin tester consists of at least one inductive coin detector made up of coil 3 and detector circuit 4 and which serves as a scanning element on the coin channel 1 to measure a predetermined dimension of a coin 2 such as the diameter of coin 2, the type of coin alloy etc., or to ascertain the presence of a coin 2 in the coin channel 1.

The coil 3 has at least one flat, helicoidal conductor arrangement 11 so that the coil 3 may be installed on a coin channel 1 in as space-saving a manner as possible. Alternating current in the conductor arrangement 11 of coil 3 produces an alternating magnetic field which goes through the coin channel 1 at a right angle to the direction of movement 13 of the coin 2, e.g., in such manner that the coil axis 12 is also aligned parallel to the axis of the coin moving past coil 3.

Figure 2:
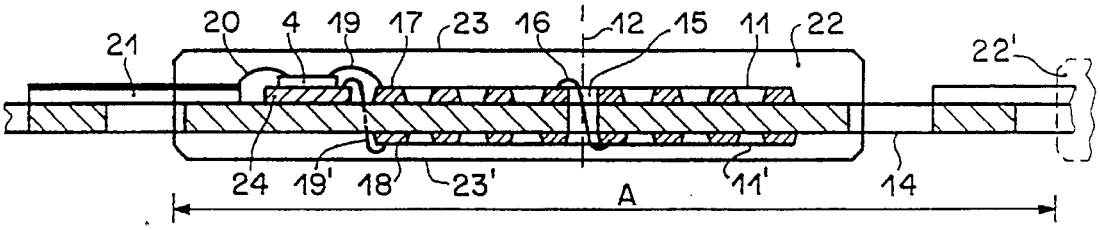
FIG. 2 shows the coin detector of FIG. 1 in cross-section.

In FIG. 2, coil 3 (seen in FIG. 1) is provided with two flat helicoidal conductor arrangements 11 and 11' on either side which are coaxially aligned with each other on an insulating film 14 and which can be connected electrically to each other by means of a through-going bond 16 going through the center 15 of the coil 3. The coil axis 12, represented by a broken line perpendicular to the plane of the conductor arrangement 11 or 11', penetrates through the center 15. Starting at the center the conductor arrangement 11 or 11' winds around the coil axis 12 up to the periphery of the conductor arrangement 11 or 11' and ends in a coil connection 17 or 18. Any electrically conductive material can be used for the conductor arrangement 11, 11', but copper is preferable because it is inexpensive.

The two conductor arrangements 11 and 11' can be connected by means of the through-going bond 16 into a flat two-layer coil 3 whose windings are made up of the conductor arrangements 11 and 11'. In order to increase the inductivity of the coil 3, the two conductor arrangements 11 and 11' have the same sense of winding.

In addition to the conductor arrangement 11, the detector circuit 4 is located on the insulation film 14. The coil connections 17, 18 of the two-layer coil 3 are connected via two short bridges 19, 19' to the detector circuit 4, whereby one bridge 19' leads through the insulation film 14 to the other side to the coil connection 18. The detector circuit 4 has connection surfaces for contact which are connected via connections 20 to the terminal lugs 21 of the feeders 7 (FIG. 1) and the signalling line 9 (FIG. 1).

To obtain lower inductivity, coil 3 can also be made in one layer. The insulation film 14 can support the conductor arrangement 11 on only one side or only the one conductor arrangement 11 or 11' is connected, with the through-going bond 16 missing. The bridges 19, 19' end at the center 15 on the coil side, and at coil contact 17 or 18.

To increase stability, the coin detector is housed advantageously in a flat housing 22. By spraying a synthetic material around the coil 3 and the detector circuit 4, a flat and stable housing 22 can be produced at low cost. The two flat sides 23, 23' of the housing 22 are traversed vertically by the coil axis 12. Traversing the material of the housing 22, the terminal lugs 21 establish the connection to the feeders 7 (FIG. 1) and to the signalling line 9 (FIG. 1). Instead of the connection fields 21, it is also possible to take the feeders 7 and the signalling line in form of wire ends directly to the outside for direct connection to the feeding device 5 (FIG. 1) and the evaluation unit 6 (FIG. 1), since three strands are sufficient for the required lines 7, 9 between the coin detector and the feeding device 5 and the evaluation unit 6.

A low-cost manufacture of the coin detector is in a row on a band-shaped insulation film 14, whereby the positioning of the coil 3, the detector circuit 4, the terminal lugs 21 and the housing 22, 22' repeats itself at a register interval A along the insulation film 14.

Figure 3:
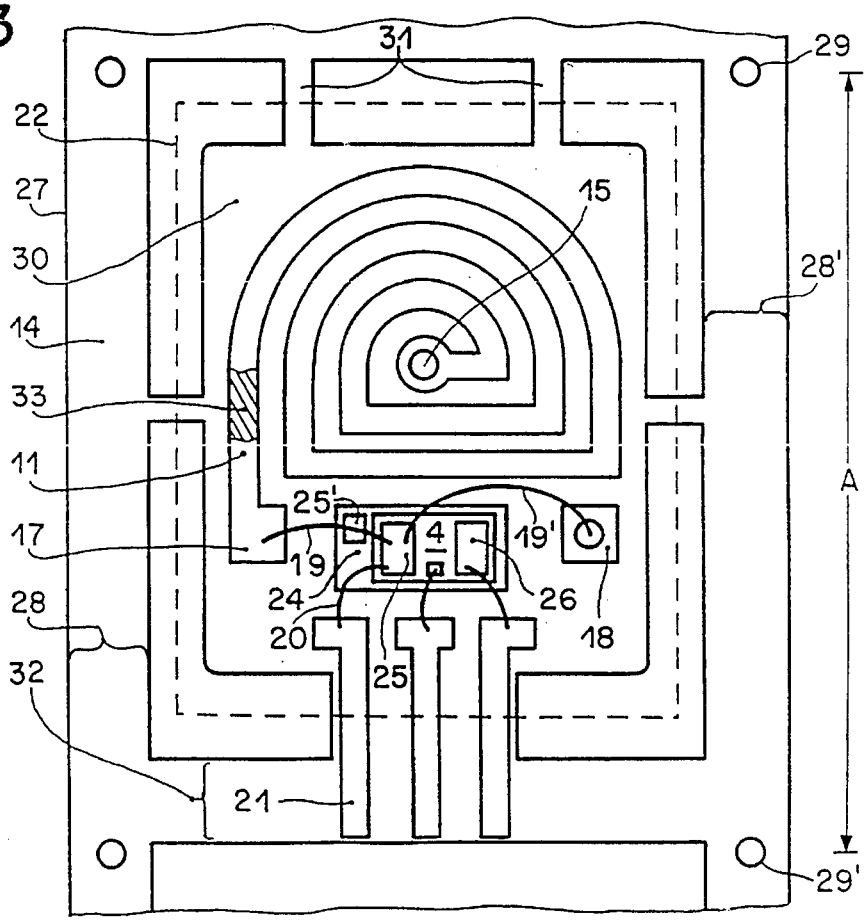
FIG. 3 shows a section from a printed board assembly strip.

The detector circuit 4 is glued to a substrate 24 made of a conductive material and comprises, as shown in FIG. 3, an oscillator circuit 25 and a measuring circuit 26. The oscillator circuit 25 in combination with coil 3 (FIG. 1) constitutes an LC oscillator with the coil 3 as inductivity. Examples of such LC oscillators are described in the book "Halbleiter-Schaltungstechnik" (Semiconductor Circuitry) by U. Tietze and Ch. Schenk, Springer Verlag, Berlin, 1978, ISBN 3-540-08628-5, pages 419 to 430, 4th edition. The alternating current produced by the oscillator circuit 25 in coil 3 produces the alternating magnetic field of the coin detector in the coin channel 1 (FIG. 1). When no coin 2 (FIG. 1) is present in the alternating magnetic field, the LC oscillator oscillates at a predetermined idling frequency $f_o$.

As soon as the material of the coin 2 withdraws energy from the alternating field the frequency f of the LC oscillator changes. The measuring circuit 26 is equipped to measure the frequency difference $\delta f = f - f_o$ and transmits a signal representing the frequency deviation $\delta f$ via signalling line 9 (FIG. 1) to the evaluation circuit 6 (FIG. 1).

When electrical energy arrives via terminal lugs 21, the LC oscillator of the coin detector begins to oscillate, whereby the inductivity of coil 3 and a capacitor of the oscillator circuit 25 in parallel connection with coil 3 determines the frequency $f_o$. Since the coil 3 and the capacitor in the oscillator circuit 25 can be made to very narrow tolerances, the idling frequency $f_o$ is scattered over a narrow band so that a coordination of the LC oscillator with the predetermined idling frequency $f_o$ can be omitted.

Depending on the number of windings and the number of conductor arrangements 11, 11' (FIG. 2) connected in series (FIG. 2), the coil preferably has an inductivity between 0.5 μH and 50 μH. The two-layer coil 3, with a predetermined diameter in this exemplary embodiment of 14 mm of the two conductor arrangements 11, 11', has an inductivity of 2920 nH for a total of 20 windings. The single-layer coil 3 preferably has only one fourth of the inductivity with a conductor arrangement 11 of identical diameter and with 10 windings, i.e., 730 nH. The coils 3 preferably have a quality factor Q ranging from 5 to 10. The measured quality factor of the single-layer coil 3 is preferably Q=8. Idling frequencies $f_o$ suitable for the coin detector preferably range from 1 MHz to 10 MHz.

The coin detector has the advantage that due to the short bridges 19, 19' between the oscillator circuit 25 and the coil 3, it is possible to provide an LC oscillator with little parasitic radiation and which is low in cost due to a manufacturing process which can be automated. Despite the high frequencies f of the LC oscillator, the feeders 7 and the signalling line 9 do not emit any parasitic electromagnetic waves which would impair the functioning of the coin tester and would impose an additional load on the LC oscillator. The compact coin detector can be installed easily at the coin channel 1 in the coin tester and is characterized by low power consumption.

It is also contemplated that the coin detector can also be used as a sensor in general, detecting the approach of a piece of metal in the alternating field of coil 3.

The oscillator circuit 25 and the measuring circuit 26 can be made on a silicon wafer chip according to CMOS technology. This manner of proceeding lowers the current consumption of the detector circuit 4. In one preferred embodiment, the current consumption is less than 30 μA with a network voltage of 5 V when the LC oscillator with the single-layer coil 3 oscillates at an idling frequency $f_o$ of approximately 16 MHz.

The insulation film 14 is provided with the conductor arrangement 11 or 11', the terminal lugs 21 and the substrate 24 on at least one side. These conductor elements 11, 17, 21, and 24 or 11, 11', 17, 18, 21, and 24 made of an electrically conductive material can be applied in a printing process or by vapor deposition or precipitation on one or both sides of the insulation film 14. The manufacture of the coin detectors is described below step by step in an example in which the conductor elements 11, 17, 21, and 24, or 11, 11', 17, 18, 21, and 24 are etched out of the conductive material laminated on one or both sides on the insulation film 14. The electrical conductive material preferably has a thickness between 0.01 mm and 0.15 mm or more. The thicker conductive material imparts advantageous rigidity to the terminal lugs 21.

A band 27 or a commercially available KAPTON® film, which film has a thickness of 70 μm and a layer of 17 μm copper on both sides, can be used as the flexible insulation foil 14.

The manufacturing process is broken down into the following steps:

a) In a border zone 28 or in both border zones 28, 28' along the band 27 or film, positioning holes 29, 29' are first punched at least at the register interval A. At the same time a support sheet 30 is punched free at the register interval A, leaving only narrow ridges 31 going to the border zones 28, 28' and transversal ridges 32 connecting the two border zones 28, 28'. The transversal ridges 32 lend sufficient stability to the band 27 for further processing.

b) Aligned with the positioning holes 29, 29' and at the register interval A, surfaces provided for the conductive elements 11, 17, 21, 24 or 11, 11', 17, 18, 21, 24 are covered with etching masks. In the drawing of FIG. 3 the etching mask 33 is symbolically indicated by hatch marks.

c) The conductive material uncovered next to the etching masks 33 is etched off.

d) The etching masks 33 are washed off with solvents.

e) The substrate 24, aligned with the positioning holes 29, 29', is attached together with the detector circuit 4 on a surface of the support sheet 30 which has been uncovered by etching. The terminal lugs 21 are connected via connection 20 to the detector circuit 4.

f) The oscillator circuit 25 is connected via bridges 19, 19' to the center of the coil 15 and the coil connection 17 in case of a single-layer coil 3 and at the two coil connections 17 and 18 in case of a two-layer coil 3 to the LC oscillator, and in the case of the two-layer coil 3, the through-going bond 16 (FIG. 2) is additionally produced at the center 15.

g) The support sheet 30 which supports coil 3 and the detector circuit 4 is aligned with the positioning holes 29, 29' and is pressed into a synthetic material together with the terminal lugs 21 so that the synthetic material constitutes the flat housing 22 drawn in with hatch 25 marks, whereby approximately the first fourth of each ridge 31, as seen from the support sheet 30, is enclosed in the housing 22, 22' (FIG. 2) and whereby the housings 22, 22' following each other in a row (FIG. 2) are separated in the area of the transversal ridges by at least the width of the latter.

h) The coin detectors are separated into integrated modules, ready to be built in, by cutting the ridges 31 and punching the terminal lugs 21 free from the transversal ridge 32.

The coil 3, as part of the "lead frame", is produced from band 27 together with the substrate 24 and the terminal lugs 21. The advantage of this process is its suitability for automated manufacture of the coin detector, since all the connections 16, 19, 19', 20 can be produced at low cost on the support sheet 30 by bonding thin wires, if the detector circuit 4 is integrated on a semiconductor chip and the frequency-determining capacitor of the oscillator circuit 25 is installed as a separate building block 25' on substrate 24 and is directly connected to the coil connections 17, 18.

The coin detector can be adjusted between the process steps f) and g), with the value of the idling frequency $f_o$ measured at the LC oscillator being stored in the measuring circuit 26 to calculate the frequency difference $\delta f$.

The production process can be modified for two-layer coils 3 to the extent that the conductor arrangements 11 are produced first, following production steps a) to d), on the band 27 which is laminated on one side. The sides without conductors of two identical bands 27 processed in this manner are then aligned on the positioning holes 29, 29' and are joined into a combination strip in which the conductor arrangements 11 are located on both sides of the combination strip and are also coaxial in the same winding direction. The combination strip continues to be processed in the subsequent production steps e) to h) as a two-sided laminated band 27.

While the invention has been particularly shown and described with reference to preferred embodiments thereof, it will be understood by those skilled in the art that various changes in form and details may be made therein without departing from the spirit and scope of the invention.

I claim:

1. A process for producing an inductive coin detector having a single coil, an oscillator, and a detector circuit on a single housing to be affixed to one side of a coin chute, the process comprising the steps of:

(a) punching positioning holes at predetermined intervals of border zones of a band made from a flexible insulator film laminated on one side with conductive material (b) punching a support sheet partially free from the band, leaving narrow ridges as connections to the border zone and transversal ridges connecting the border zones to each other;

(c) covering with etching masks conductive material surfaces provided for conductive elements, which elements are on a substrate in alignment with the positioning holes;

(d) etching exposed, superfluous conductive material;

(e) removing the etching masks;

(f) attaching a detector circuit to a substrate and aligned with the positioning holes on a surface of the support sheet exposed by removing the etching masks;

(g) producing connecting bridges from terminal lugs to the detector circuit and from both ends of the coil to the detector circuit forming an oscillator circuit;

(h) surrounding the detector-circuit bearing support sheet with a synthetic material so that the synthetic material constitutes a flat housing having sides aligned to be parallel with a plane of the conductor elements; and (i) cutting the narrow and traversal ridges and the terminal lugs free.

2. The method of claim 1, wherein the step of connecting further comprises bonding thin wires to produce the bridges.

3. A process for manufacturing an inductive coin detector having a single coil, an oscillator, and a detector circuit on a single housing to be affixed to one side of a coin chute, the process comprising the steps of:

(a) punching positioning holes at predetermined intervals of border zones of a band made from a flexible insulation film laminated on both sides with conductive material (b) punching partially free a supporting sheet from the band, said support sheet remaining partially connected to the border zones by narrow ridges and to transversal ridges connecting the border zones;

(c) covering with etching masks conductive material provided for a conductor element on a substrate in alignment with the positioning holes;

(d) etching uncovered, superfluous conductive material;

(e) removing the etching masks;

(f) attaching a detector circuit to a substrate in alignment with the positioning holes on a surface of the support sheet uncovered by removing the etching masks;

(g) producing connecting bridges from terminal lugs to the detector circuit, and a going through bond from the center of the coil on one side to the center to the coil on the other side of the sheet, and connections from both ends of the coil to the detector circuit forming an oscillator circuit to the coil;

(h) surrounding the detector-circuit bearing support sheet with a synthetic material so that the synthetic material constitutes a flat housing having the flat sides aligned to be parallel with a plane of the conductor elements; and (i) cutting the ridges and terminal lugs free.

4. The process of claim 3, wherein the step of attaching further comprises bonding thin wires to produce connections.

* * * * *